US012653329B2

(12) United States Patent
Yang

(10) Patent No.: US 12,653,329 B2
(45) Date of Patent: Jun. 16, 2026

(54) CRIB

(71) Applicant: Wonderland Switzerland AG, Steinhausen (CH)

(72) Inventor: Tao Yang, Steinhausen (CH)

(73) Assignee: Wonderland Switzerland AG, Steinhausen (CH)

( * ) Notice: Subject to any disclaimer, the term of this patent is extended or adjusted under 35 U.S.C. 154(b) by 60 days.

(21) Appl. No.: 18/570,844

(22) PCT Filed: Jun. 15, 2022

(86) PCT No.: PCT/EP2022/066428
§ 371 (c)(1),
(2) Date: Dec. 15, 2023

(87) PCT Pub. No.: WO2022/263577
PCT Pub. Date: Dec. 22, 2022

(65) Prior Publication Data

US 2025/0009144 A1 Jan. 9, 2025

(30) Foreign Application Priority Data

Jun. 16, 2021 (CN) ..... 202121340674.8

(51) Int. Cl.
*A47D 9/00* (2006.01)

(52) U.S. Cl.
CPC ..... *A47D 9/012* (2022.08)

(58) Field of Classification Search
CPC ..... A47D 9/00; A47D 9/005; A47D 9/008; A47D 9/012
See application file for complete search history.

(56) References Cited

U.S. PATENT DOCUMENTS

2012/0017369 A1 1/2012 Li
2022/0235804 A1* 7/2022 Chui ..... A47D 9/005
2022/0330713 A1* 10/2022 Yang ..... A47D 9/00
2023/0200558 A1* 6/2023 Yang ..... A47D 9/012 5/98.1
2023/0337837 A1* 10/2023 Mo ..... A47D 9/012
(Continued)

FOREIGN PATENT DOCUMENTS

CN 201938884 U 8/2011
CN 203424654 U 2/2014
(Continued)

OTHER PUBLICATIONS

International Search Report and Written Opinion for Application No. PCT/EP2022/066428 dated Sep. 15, 2022.

*Primary Examiner* — David E Sosnowski
(74) *Attorney, Agent, or Firm* — Volpe Koenig

(57) ABSTRACT

A crib includes a body and a support frame supporting the body. The support frame includes a lower frame, an upper frame and an operating module. The lower frame is configured to stand on a plane and has a lower support rod. The upper frame is connected to the body and has an upper support rod. The upper support rod and the lower support rod are sleeved with each other. The upper support rod is capable of moving upward and downward with respect to the lower support rod. The operating module is connected to the lower support rod and the upper support rod and configured to lock and unlock the upper support rod and the lower support rod.

12 Claims, 11 Drawing Sheets

(56) References Cited

U.S. PATENT DOCUMENTS

| | | | | |
|---|---|---|---|---|
| 2024/0008658 | A1* | 1/2024 | Zhong | A47D 9/005 |
| 2025/0185821 | A1* | 6/2025 | Hu | A47D 9/012 |
| 2025/0319722 | A1* | 10/2025 | Tully | A47D 9/00 |

FOREIGN PATENT DOCUMENTS

| | | | |
|---|---|---|---|
| CN | 205947527 | U | 2/2017 |
| CN | 207561646 | U | 7/2018 |
| CN | 207565671 | U | 7/2018 |
| CN | 211130442 | U | 7/2020 |
| CN | 211269622 | U | 8/2020 |
| JP | 2003225145 | A | 8/2003 |
| TW | 201212857 | A1 | 4/2012 |

* cited by examiner

CRIB

CROSS-REFERENCE TO RELATED APPLICATIONS

This application is a National Stage application of PCT/EP2022/066428, filed on Jun. 15, 2022, which claims the benefit of Chinese Application No. 202121340674.8, filed on Jun. 16, 2021, both of which are incorporated herein by reference in their entirety.

FIELD

The present disclosure relates to a crib, particularly a crib capable of adjusting a height thereof.

BACKGROUND

Generally, a height of a body of most of cribs cannot be adjusted. A few cribs allow the height of the body to be adjusted. However, when adjusting the height of the body, it is not easy to make two sides of the body move synchronously, such that the operation is inconvenient.

SUMMARY

The present disclosure provides a crib. The crib includes a body and a support frame supporting the body. The support frame includes a lower frame, an upper frame and an operating module. The lower frame is configured to stand on a plane and has a lower support rod. The upper frame is connected to the body and has an upper support rod. The upper support rod and the lower support rod are sleeved with each other. The upper support rod is capable of moving upward and downward with respect to the lower support rod. The operating module is connected to the lower support rod and the upper support rod and configured to lock and unlock the upper support rod and the lower support rod.

BRIEF DESCRIPTION OF THE DRAWINGS

In the following, the present disclosure is further illustrated by way of example, taking reference to the accompanying drawings thereof.

DETAILED DESCRIPTION

Figure 1:
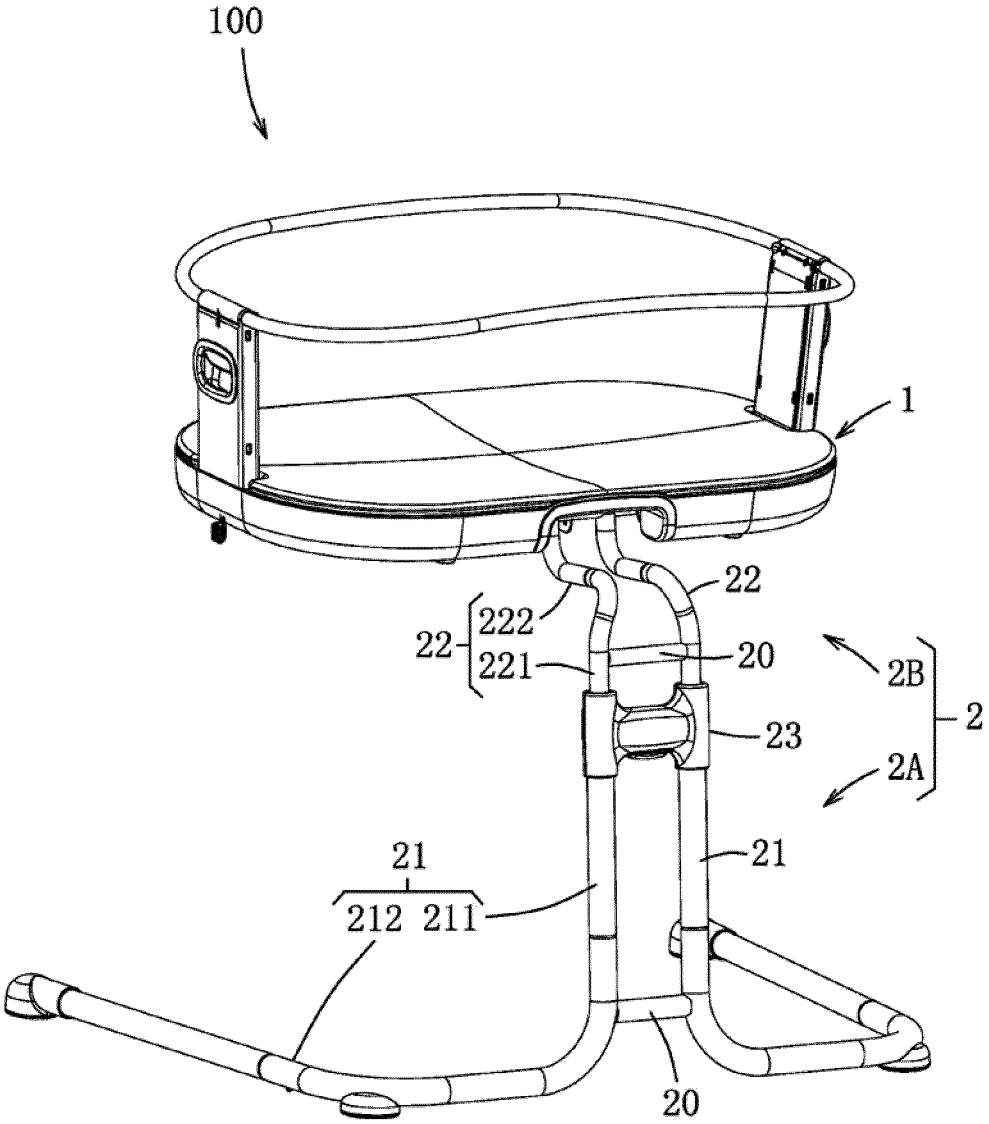
FIG. 1 is a perspective view illustrating a crib according to a first embodiment of the present disclosure.

The present disclosure will be further described with the embodiments and drawings in the following. Before describing the present disclosure in detail, it should be noted that similar numbers in the drawings represent similar elements. Furthermore, the terms "first", "second" and "third" mentioned in the present disclosure are only used to distinguish different embodiments rather than to indicate the priority of the embodiments.

First Embodiment

Figure 2:
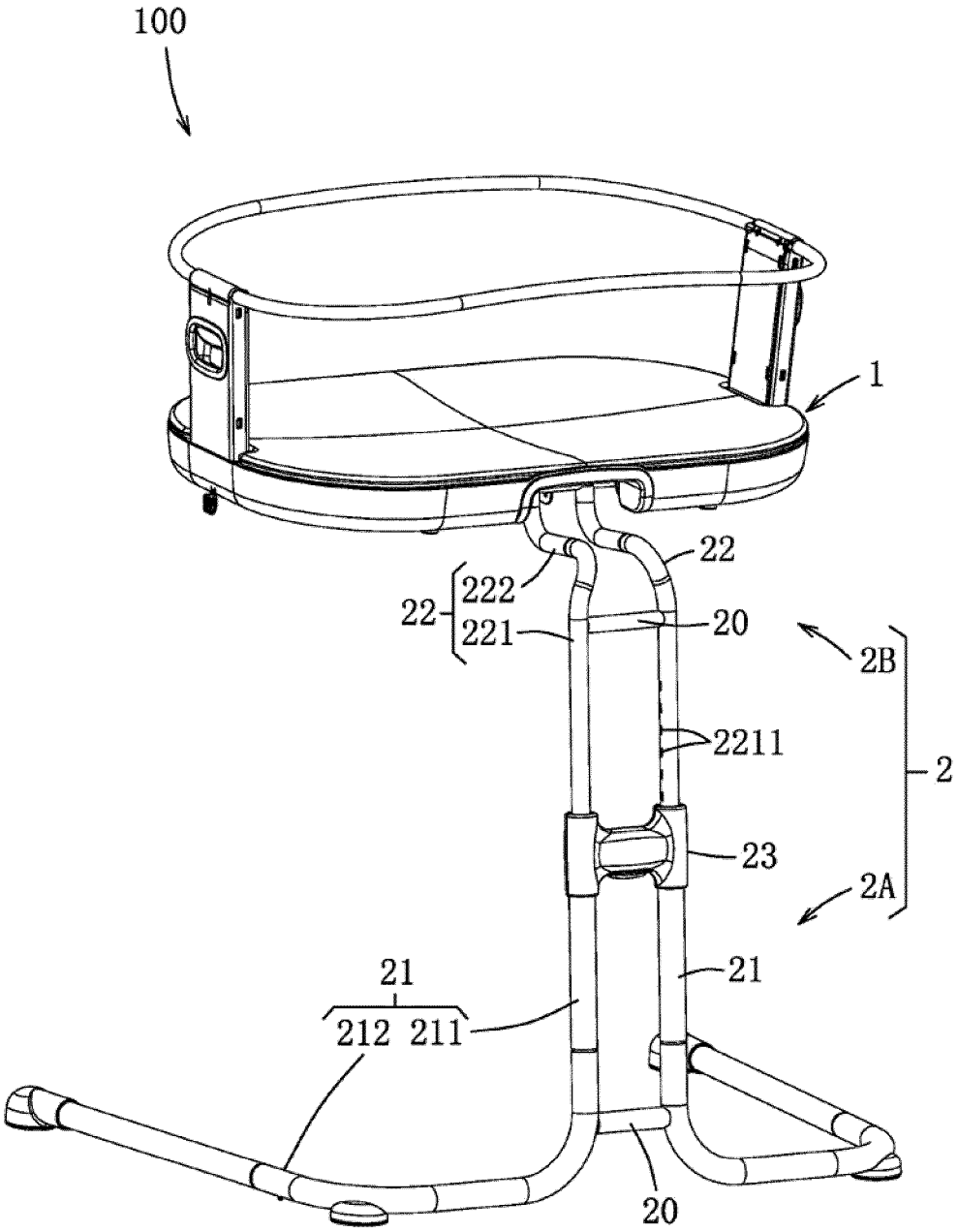
FIG. 2 is a perspective view illustrating a body of the first embodiment located at different height.
Figure 3:
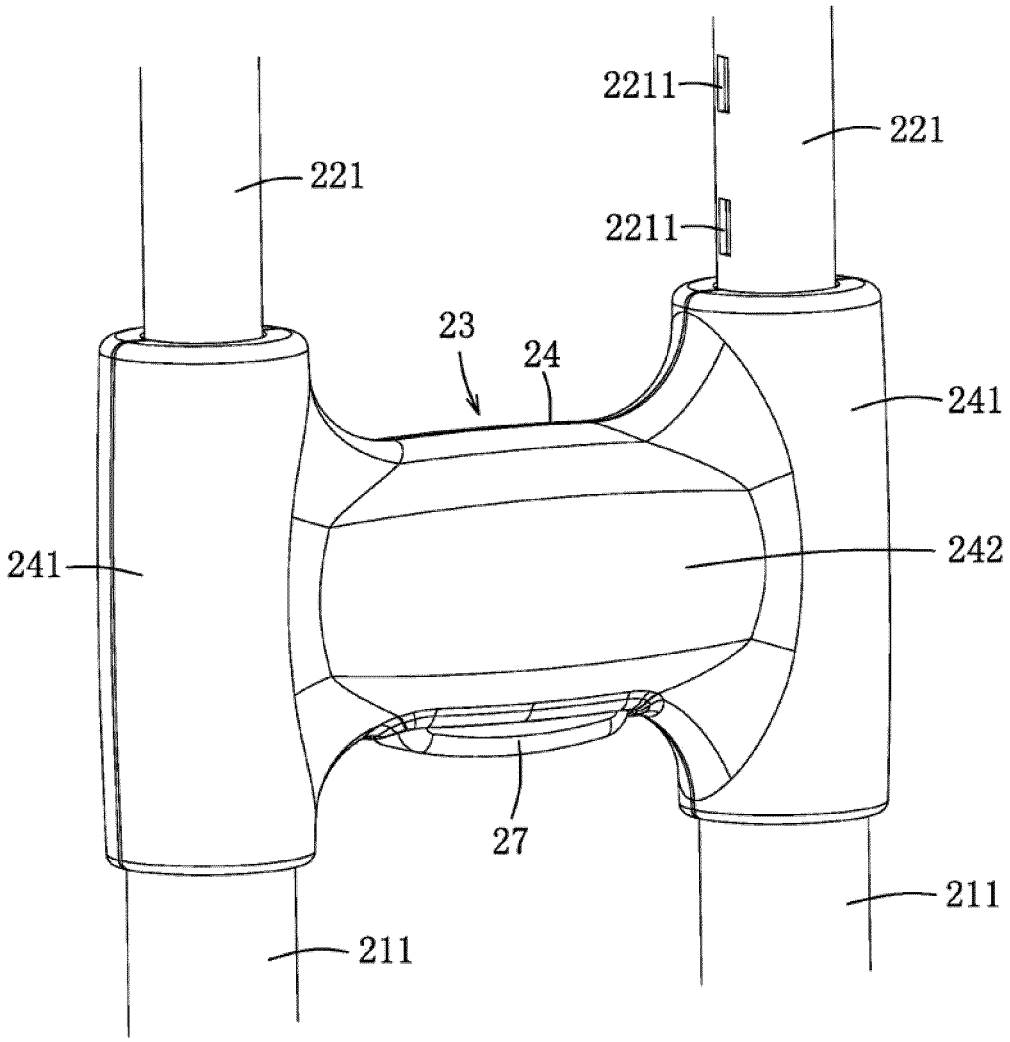
FIG. 3 is an enlarged view illustrating a partial area of FIG. 2.

Referring to FIGS. 1 to 3, a crib 100 of a first embodiment of the present disclosure includes a body 1 and a support frame 2 supporting the body 1. The support frame 2 includes a lower frame 2A, an upper frame 2B and an operating module 23. The lower frame 2A stands on a plane (e.g. ground) and has a lower support rod 21. The upper frame 2B is connected to the body 1 and has an upper support rod 22. The operating module 23 is connected to the lower support rod 21 and the upper support rod 22. The upper support rod 22 and the lower support rod 21 are sleeved with each other. The upper support rod 22 is capable of moving upward and downward with respect to the lower support rod 21 to adjust a height of the body 1. The operating module 23 is configured to lock and unlock the upper support rod 22 and the lower support rod 21.

In this embodiment, the lower frame 2A has two lower support rods 21. Each of the lower support rods 21 has a hollow and upright outer tube segment 211 and a bottom support segment 212 bent and extended from the outer tube segment 211 downward to stand on the plane. The upper frame 2B has two upper support rods 22. Each of the upper support rods 22 has an upright inner tube segment 221 and a top support segment 222 bent and extended from the inner tube segment 221 upward to connect and support the body 1. The outer tube segment 211 and the inner tube segment 221 are located below a side of the body 1. Two connecting rods 20 respectively connect two outer tube segments 211 and two inner tube segments 221 to increase support strength.

Referring to FIGS. 3 to 6, the outer tube segments 211 of the lower support rods 21 are arranged side by side and each of the outer tube segments 211 has a tube opening 2111 at the top and an opening portion 2112 facing the other outer tube segment 211. The inner tube segment 221 of the upper support rod 22 is inserted into the outer tube segment 211 from the tube opening 2111 and capable of sliding upward and downward with respect to the outer tube segment 211 to adjust a length extending out of or retracted into the tube opening 2111, so as to adjust a height of the body 1 (as shown in FIG. 1). Each of the inner tube segments 221 has a plurality of lock portions 2211 arranged in an up-down direction and the position of one of the lock portions 2211 corresponds to the opening portion 2112. In the first embodiment, the opening portion 2112 and the lock portions 2211 are longitudinal holes extending in the up-down direction. The support frame 2 further includes two anti-releasing sleeves 28 and two retaining members 29. The anti-releasing sleeve 28 is sleeved on a lower end of the inner tube segment 221. The retaining member 29 is disposed on the tube opening 2111 for the anti-releasing sleeve 28 to abut against, so as to prevent the inner tube segment 221 from being separated from the outer tube segment 211.

The operating module 23 includes a fixing base 24, two lock members 25, a returning member 26 and an unlock member 27.

The fixing base 24 is connected to the outer tube segment 211 and the position of the fixing base 24 corresponds to the opening portion 2112. In the first embodiment, the fixing base 24 has two sleeve portions 241 disposed on the outer tube segments 211 and a mounting portion 242 connected to the sleeve portions 241. The mounting portion 242 has a transverse accommodating groove 243 extending in a left-right direction and communicating with the opening portion 2112 and a longitudinal accommodating groove 244 extending in the up-down direction and communicating with the transverse accommodating groove 243. The lock member 25 and the returning member 26 are accommodated in the transverse accommodating groove 243. The unlock member 27 is accommodated in the longitudinal accommodating groove 244 and partially extends out of the mounting portion 242 for pressing.

Figure 4:
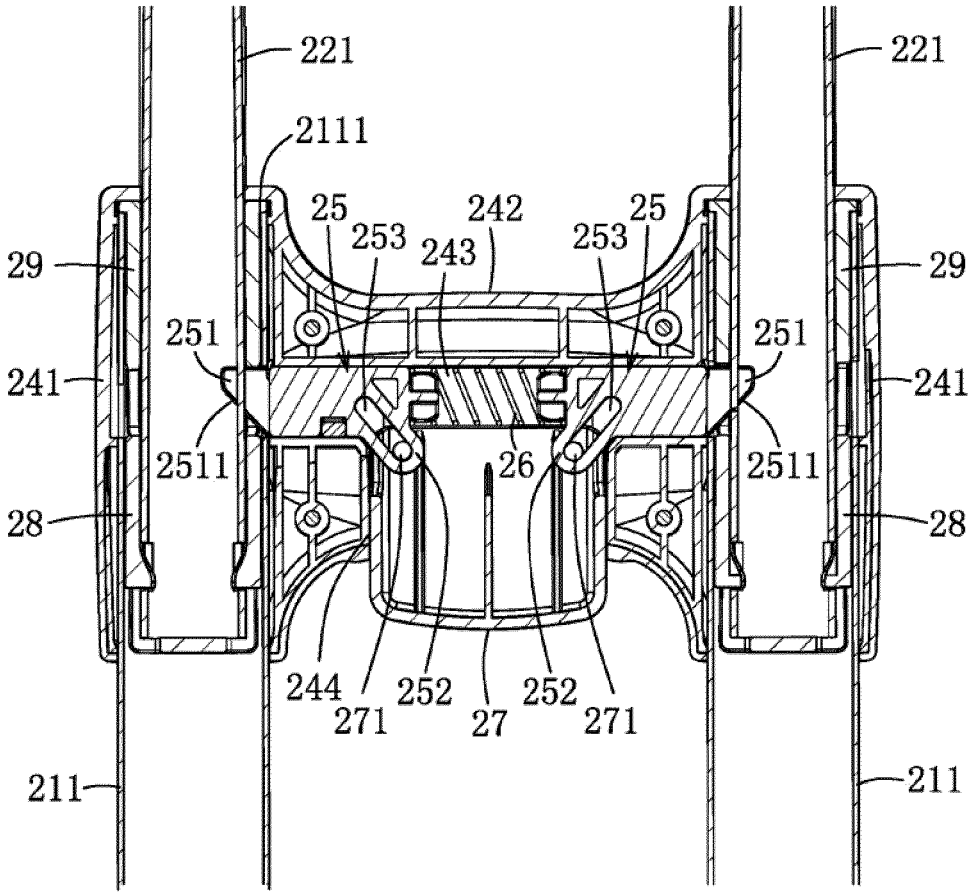
FIG. 4 is a sectional view corresponding to FIG. 3, wherein an operating module of the first embodiment is located at a lock position.
Figure 5:
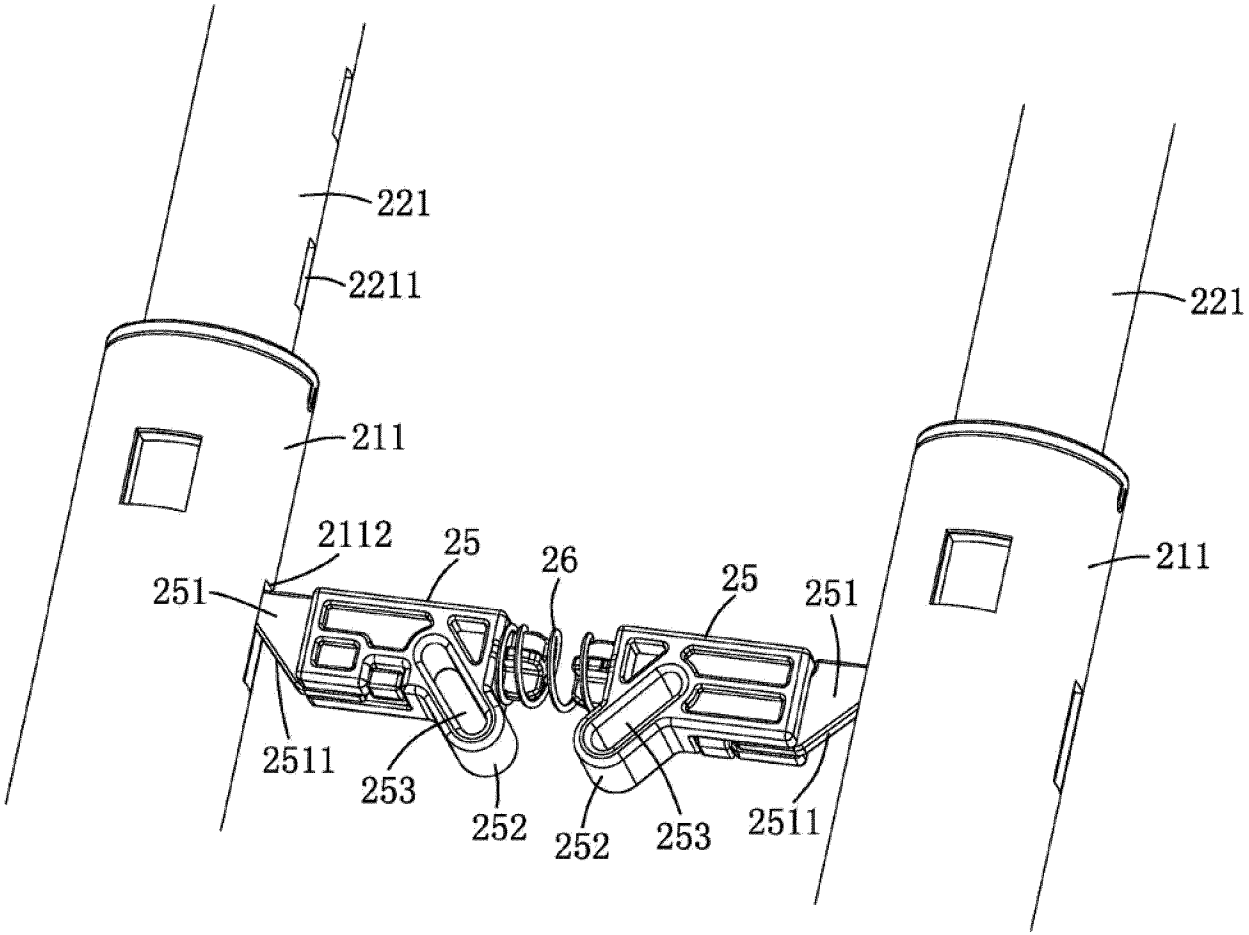
FIG. 5 is a perspective view similar to FIG. 3, wherein a fixing base and an unlock member of the operating module are removed.
Figure 6:
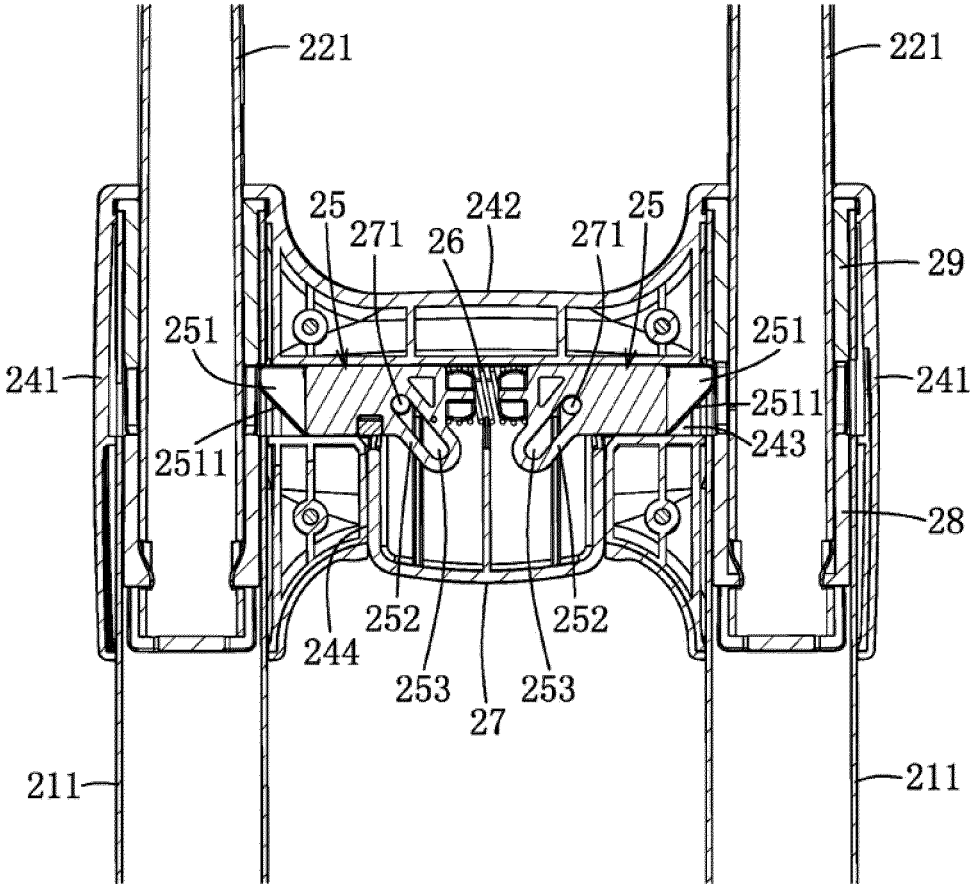
FIG. 6 is a sectional view similar to FIG. 4, wherein the operating module of the first embodiment is located at an unlock position.

The lock members 25 are disposed in the fixing base 24 and capable of moving between a lock position (as shown in FIG. 4) and an unlock position (as shown in FIG. 6). Each of the lock members 25 has an interfering portion 251 extending into the corresponding opening portion 2112 to engage with one of the lock portions 2211 at the lock position and a driving portion 252 for the unlock member 27 to drive. In other words, when the position of one of the lock portions 2211 of the inner tube segment 221 is aligned with the opening portion 2112, the corresponding interfering portion 251 can pass through the opening portion 2112 and extend into the lock portion 2211 aligned with the opening portion 2112. Thus, when the lock member 25 is located at the lock position, the interfering portion 251 extends into the lock portion 2211 to restrain the inner tube segment 221 from moving downward. In this embodiment, the driving portion 252 has an inclined slot 253. Two inclined slots are arranged symmetrically in a direction gradually approaching each other from top to bottom. The returning member 26 is connected to the lock member 25 and keeps the lock member 25 returning to the lock position. In the first embodiment, the returning member 26 is a compression spring and opposite ends of the returning member 26 respectively abut against two lock members 25. The lock members 25 and the returning member 26 are accommodated in the transverse accommodating groove 243, such that the lock members 25 can only move in the left-right direction linearly.

The unlock member 27 is disposed on the fixing base 24 and can be pressed. The unlock member 27 has two pin components 271 capable of sliding along the inclined slots 253. The unlock member 27 is pressed to move in the up-down direction and slides along the inclined slots 253 through the pin components 271, so as to drive the lock members 25 to approach each other in the left-right direction and then move from the lock position to the unlock position. Consequently, the interfering portion 251 is disengaged from the lock portion 2211. In the first embodiment, the unlock member 27 is accommodated in the longitudinal accommodating groove 244 and partially extends out of the mounting portion 242 for pressing. The unlock member 27 is restrained by the longitudinal accommodating groove 244, such that the unlock member 27 can only move in the up-down direction linearly. As shown in FIG. 4, before the unlock member 27 is pressed, the lock members 25 is located at the lock position and the pin component 271 is located at a lower end of the inclined slot 253. When a user presses the unlock member 27 from bottom to top, the unlock member 27 moves upward and the pin component 271 moves upward simultaneously. When the pin component 271 moves upward, the pin component 271 pushes an inner wall of the inclined slot 253 and slides along the inclined slot 253, so as to drive the lock members 25 to approach each other in the left-right direction. As shown in FIG. 6, when the pin component 271 moves to an upper end of the inclined slot 253, the lock member 25 moves to the unlock position to disengage the interfering portion 251 from the lock portion 2211. At this time, the upper support rod 22 can freely move in the up-down direction.

In the first embodiment, the interfering portion 251 has a downward inclined surface 2511. When the inner tube segment 221 is forced to move upward, the lock portion 2211 moves with respect to the inclined surface 2511 and pushes the inclined surface 2511 to drive the lock member 25 to move toward the unlock position, so as to disengage the lock portion 2211 from the interfering portion 251. In other words, when a user wants to adjust the body 1 upward, the user does not need to press the unlock member 27 to move the lock member 25 to the unlock position. The user may directly pull the upper support rod 22 upward to force the inclined surface 2511 of the interfering portion 251 by a lower edge of the lock portion 2211, so as to push the interfering portion 251 out of the lock portion 2211. Until the next lock portion 221 is aligned with the opening portion 2112, the interfering portion 251 is returned by the returning member 26 and then extends into the next lock portion 221 to achieve auto lock. When the user wants to adjust the body downward, the user needs to press the unlock member 27 to move the lock member 25 to the unlock position. After the body 1 descends to an appropriate height and the corresponding lock portion 2211 is aligned with the opening portion 2112, the user may release the unlock member 27, such that the lock member 25 returns to the lock position to lock the upper support rod 22.

Second Embodiment

Figure 7:
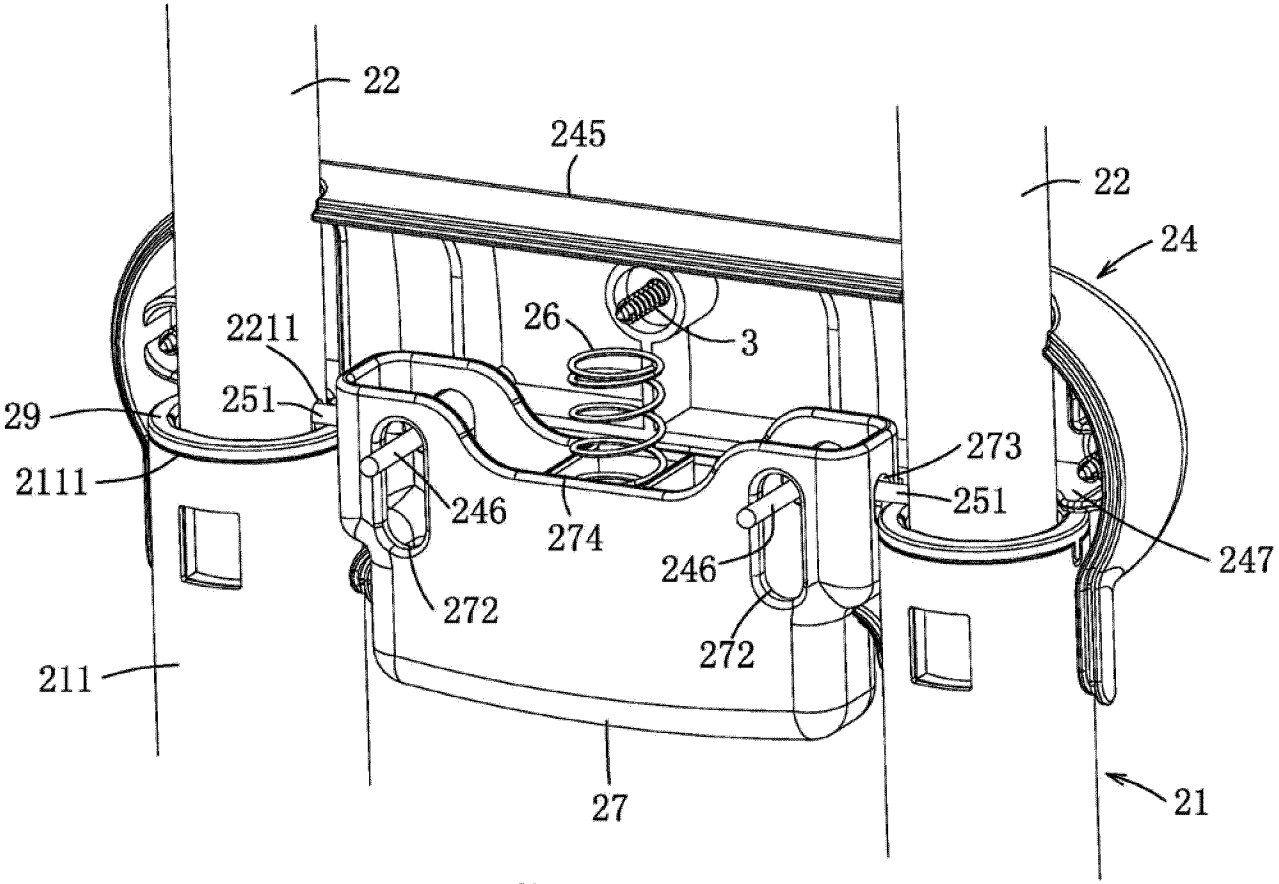
FIG. 7 is a perspective view illustrating the operating module of the crib according to a second embodiment of the present disclosure.
Figure 8:
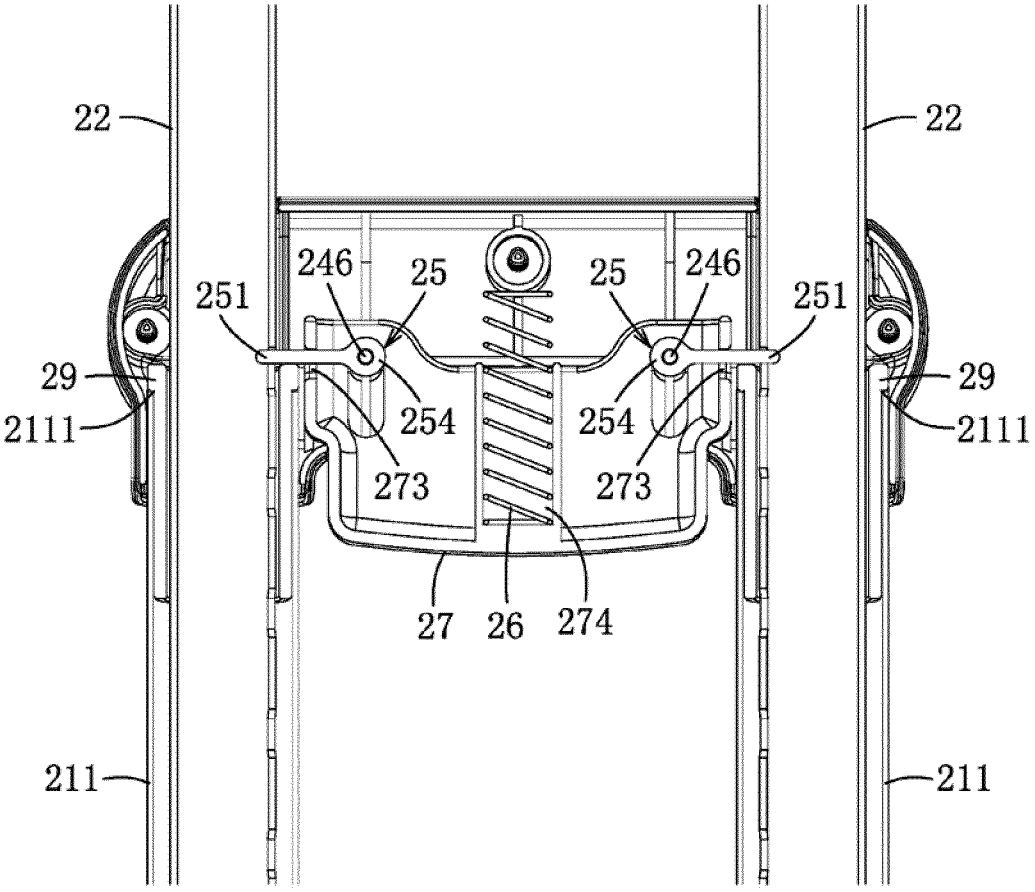
FIG. 8 is a sectional view corresponding to FIG. 7, wherein the operating module of the second embodiment is located at the lock position.
Figure 9:
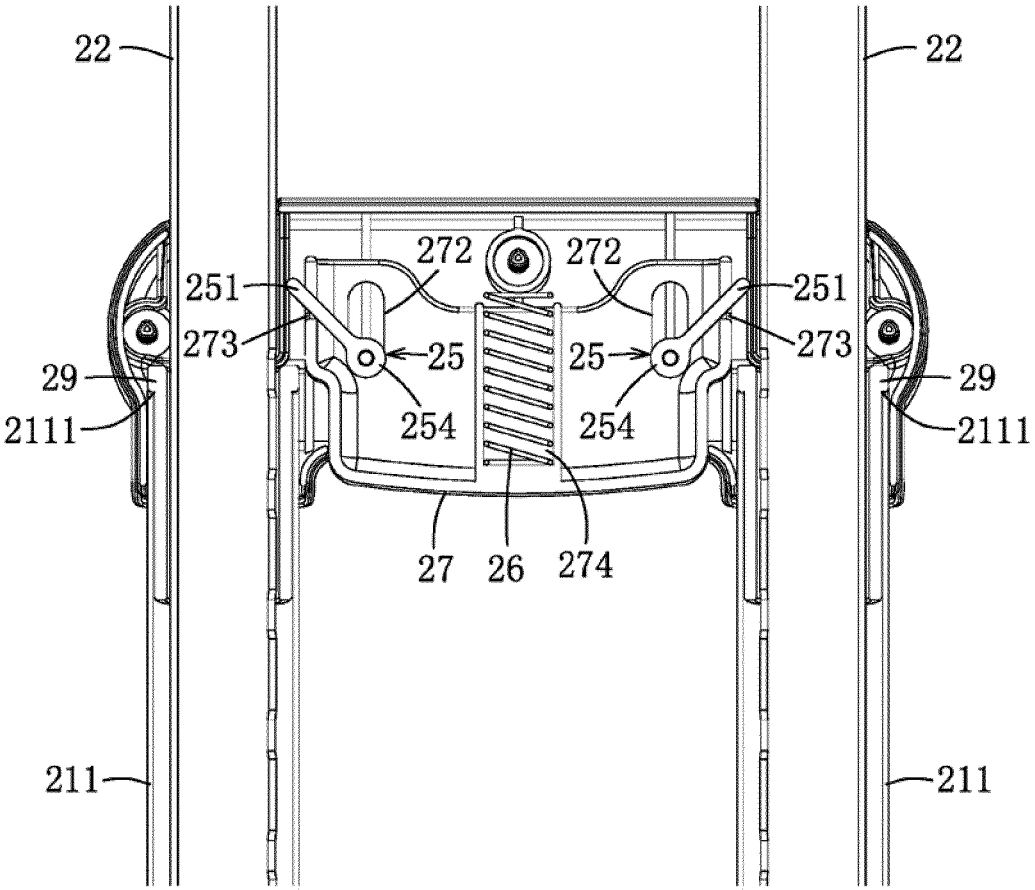
FIG. 9 is a sectional view corresponding to FIG. 7, wherein the operating module of the second embodiment is located at the unlock position.

Referring to FIGS. 7 to 9, the crib 100 of the second embodiment of the present disclosure is substantially identical to the first embodiment, but the operating module 23 has some differences. In the second embodiment, the outer tube segment 211 of the lower support rod 21 does not have the opening portion 2112 and the tube opening 2111 is located in the fixing base 24. The fixing base 24 has a casing 245, two pivots 246 and a positioning plate 247. The casing 245 forms an accommodating space. The two pivots 246 are located in the casing 245, close to the retaining member 29, and extend from the casing 245 in a front-rear direction. The positioning plate 247 is located in the casing 245 and abuts against a top surface of the retaining member 29. The lock member 25 is disposed with respect to the pivot 246. Each of the lock members 25 has a pivot portion 254 and an interfering portion 251. The pivot portion is sleeved on the pivot 246. The interfering portion 251 extends from the pivot portion 254 and abuts against the top surface of the retaining member 29 at the lock position. The unlock member 27 has an avoidance groove 272 for the pivot 246 to pass through, a restraining hole 273 for the interfering portion 251 to pass through, and a restraining groove 274 extending in the up-down direction and configured to accommodate the returning member 26. When the unlock member 27 is pressed, the unlock member 27 moves upward and drives the interfering portion 251 to rotate upward as the restraining hole 273 moves upward. The returning member 26 is a compression spring and opposite ends of the returning member 26 respectively abut against the casing 245 and the unlock member 27. For purpose of explanation, the fixing base 24 shown in FIG. 7 omits the front half part. An upper end of the returning member 26 may abut against a lower side of a stud (not shown in the figures) for fixing a bolt 3.

In the second embodiment, when a user wants to adjust the body 1 upward, the user may directly pull the upper support rod 22 upward to drive the interfering portion 251 to rotate upward by the lower edge of the lock portion 2211, so as to disengage the interfering portion 251 from the lock portion 2211. At the same time, the interfering portion 251 drives the unlock member 27 to move upward to compress the returning member 26, such that the returning member 26 stores an elastic force. When the next lock portion 2211 is aligned with the interfering portion 251, the interfering portion 251 extends into the lock portion 2211 and there is a space for the interfering portion 251 to rotate downward. At the same time, the unlock member 27 is returned by the returning member 26 and drives the interfering portion 251 to return. When the interfering portion 251 is located at the lock position, the interfering portion 251 extends into the corresponding lock portion 2211 and an upper edge of the lock portion 2211 abuts against the interfering portion 251, such that the upper support rod 21 cannot move downward. Furthermore, the lower side of the interfering portion 251 abuts against the top surface of the retaining member 29 to be supported by the lower support rod 21, so as to increase support strength. When the user wants to adjust the body 1 downward, the user may pull the upper support rod 22 upward to separate the upper edge of the lock portion 2211 from the interfering portion 251, so as to provide a space for the interfering portion 251 to rotate. Then, the user may press the unlock member 27 to drive the interfering portion 251 to rotate upward to the unlock position. After the body 1 descends to an appropriate height and the corresponding lock portion 2211 is aligned with the interfering portion 251, the user may release the unlock member 27, such that the interfering portion 251 returns to the lock position to lock the upper support rod 22.

In the second embodiment, the positioning plate 247 and the interfering portion 251 at the lock position abut against the top surface of the retaining member 29 to indirectly abut against an end surface of the lower support rod 21. In another embodiment, if there is no retaining member 29, the positioning plate 247 and the interfering portion 251 at the lock position may also directly abut against the end surface of the lower support rod 21. Therefore, the positioning plate 247 and the interfering portion 251 at the lock position may directly or indirectly abut against the end surface of the lower support rod 21.

Third Embodiment

Figure 10:
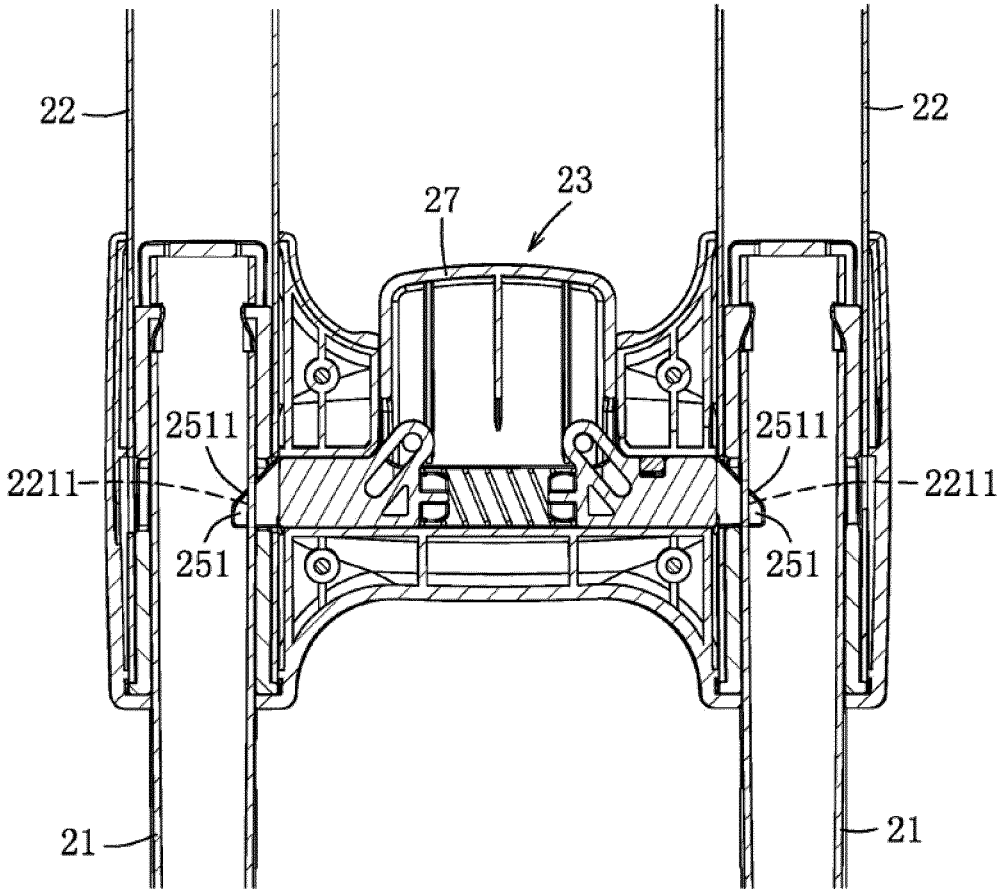
FIG. 10 is a sectional view illustrating the operating module of the crib according to a third embodiment of the present disclosure, wherein the operating module of the third embodiment is located at the lock position.
Figure 11:
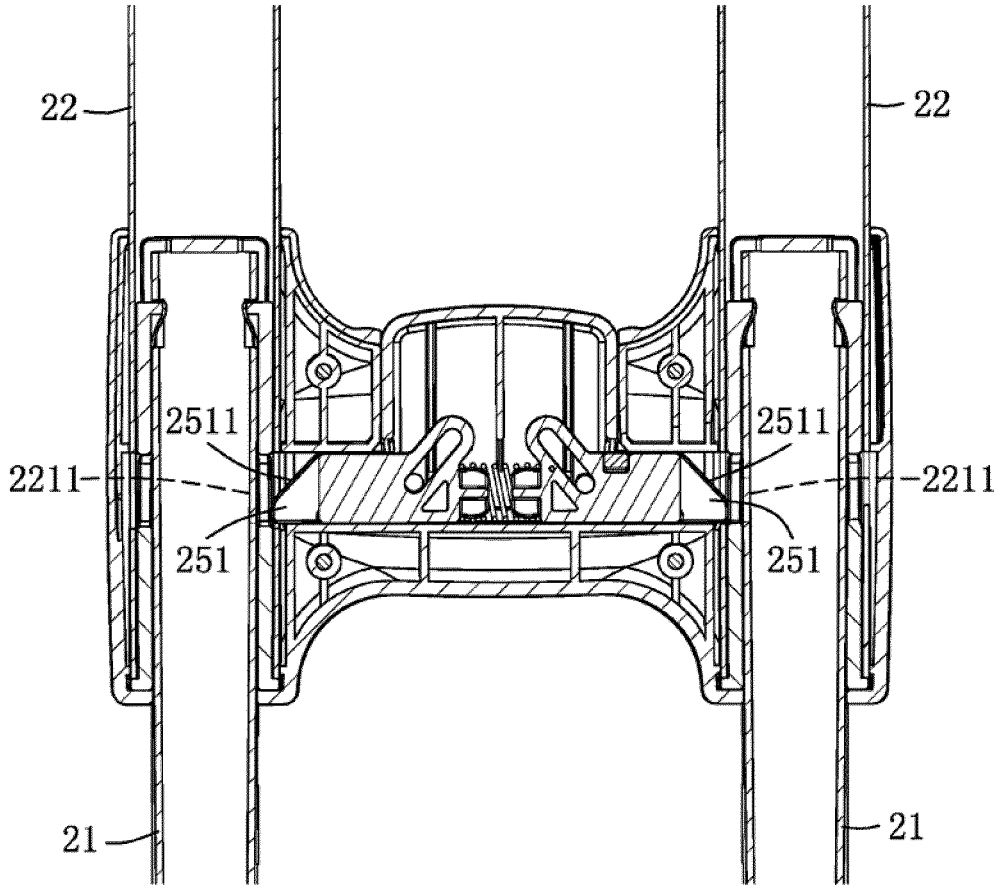
FIG. 11 is a sectional view corresponding to FIG. 10, wherein the operating module of the third embodiment is located at the unlock position.

Referring to FIGS. 10 and 11, the crib 100 of the third embodiment of the present disclosure is substantially identical to the first embodiment. However, in the third embodiment, the upper support rod 22 is sleeved on the outer side of the lower support rod 21 and the structure at the joint is upside down with the first embodiment. In other words, in the first embodiment, the lower support rod 21 is located at outer side and the upper support rod 22 is located at inner side after the upper support rod 22 and the lower support rod 21 are sleeved with each other; and in the third embodiment, the upper support rod 22 is located at outer side and the lower support rod 21 is located at inner side after the upper support rod 22 and the lower support rod 21 are sleeved with each other. Furthermore, the structure disposed on the outer tube segment 211 of the lower support rod 21 and the structure disposed on the inner tube segment 221 of the upper support rod 22 in the first embodiment are upside down in the third embodiment. That is to say, the upper support rod 22 in the third embodiment has the same structure as the outer tube segment 211 of the first embodiment, and the lower support rod 21 in the third embodiment has the same structure as the inner tube segment 221 of the first embodiment.

Likewise, in the third embodiment, the operating module 23 is upside down with the first embodiment to be disposed on the upper support rod 22 and moves in the up-down direction with the upper support rod 22. Still further, in the third embodiment, the operation and principle of the operating module 23 are substantially the same as the first embodiment and only the pressing direction of the unlock member 27 is from top to bottom, which is opposite to that of the first embodiment. When a user wants to adjust the body 1 (as shown in FIG. 1) upward, the third embodiment does not need to press the unlock member 27 either and the user may directly pull the upper support rod 22 upward to force the inclined surface 2511 of the interfering portion 251 by the upper edge of the lock portion 2211, so as to push the interfering portion 251 out of the lock portion 2211. Until interfering portion 251 moves to the next lock portion 221, the interfering portion 251 is returned by the returning member 26 and then extends into the next lock portion 221 to achieve auto lock.

Similarly, in the variation of the second embodiment, the upper support rod 22 may also be sleeved on the outer side of the lower support rod 21, and the structure at the joint is upside down with that of the second embodiment.

As mentioned in the above, the operating module 23 may be located in the middle of a long side of the body 1, such that it is convenient for a user to operate. Furthermore, the overall structure of the support frame 2 is simple and can be manufactured easily, and a weight of the support frame 2 can be reduced to facilitate the transportation and movement.

In an embodiment, a crib includes a body and a support frame supporting the body. The support frame includes a lower frame, an upper frame and an operating module. The lower frame is configured to stand on a plane and has a lower support rod. The upper frame is connected to the body and has an upper support rod. The upper support rod and the lower support rod are sleeved with each other. The upper support rod is capable of moving upward and downward with respect to the lower support rod. The operating module is connected to the lower support rod and the upper support rod and configured to lock and unlock the upper support rod and the lower support rod.

In an embodiment, one of the lower support rod and the upper support rod located at inner side has a plurality of lock portions arranged in an up-down direction. The operating module includes a fixing base, a lock member, a returning member and an unlock member. The fixing base is disposed on the other one of the lower support rod and the upper support rod located at outer side and forms a space for accommodating the lock member, the returning member and the unlock member. The lock member is disposed in the fixing base and capable of moving between a lock position and an unlock position. The lock member is fixed with one of the lock portions at the lock position. The returning member provides an elastic force for returning the lock member to the lock position. The unlock member is disposed on the fixing base. The unlock member drives the lock member to move from the lock position to the unlock position while being pressed.

In an embodiment, the other one of the lower support rod and the upper support rod located at outer side has an opening portion. The fixing base has a sleeve portion disposed on the other one of the lower support rod and the upper support rod located at outer side and a mounting portion connected to the sleeve portion. The mounting portion has a transverse accommodating groove extending in a left-right direction and communicating with the opening portion and a longitudinal accommodating groove extending in the up-down direction and communicating with the transverse accommodating groove. The lock member and the returning member are accommodated in the transverse accommodating groove. The unlock member is accommodated in the longitudinal accommodating groove and partially extends out of the mounting portion for pressing.

In an embodiment, the lock member has a driving portion for the unlock member to drive. The driving portion has a inclined slot. The unlock member has a pin component sliding along the inclined slot. The unlock member is pressed to move in the up-down direction and slides along the inclined slot through the pin component, so as to drive the lock member to move from the lock position to the unlock position in the left-right direction.

In an embodiment, the lock member further has an interfering portion engaging with one of the lock portions at the lock position.

In an embodiment, the interfering portion has an inclined surface relative to the lock portion. When the upper frame is forced to move upward, the lock portion moves with respect to the inclined surface and pushes the inclined surface to drive the lock member to move toward the unlock position, so as to disengage the lock portion from the interfering portion.

In an embodiment, the fixing base has a casing forming an accommodating space and a pivot located in the casing. The lock member is disposed on the pivot and capable of rotating with respect to the pivot. The lock member has an interfering portion. The interfering portion abuts against an end surface of the other one of the lower support rod and the upper support rod located at outer side while being located at the lock position. The unlock member has a restraining hole for the interfering portion to pass through. When the unlock member is pressed, the unlock member moves in the up-down direction and drives the interfering portion to move along the restraining hole moves.

In an embodiment, the lock member further has a pivot portion sleeved on the pivot and the interfering portion extends from the pivot portion.

In an embodiment, the unlock member further has an avoidance groove for the pivot to pass through.

In an embodiment, the unlock member further has a restraining groove extending in the up-down direction and configured to accommodate the returning member. The returning member is a compression spring. Opposite ends of the returning member respectively abut against the casing and the unlock member.

In an embodiment, the fixing base further has a positioning plate extending from the casing and abutting against the end surface of the other one of the lower support rod and the upper support rod located at outer side.

In an embodiment, the support frame further includes an anti-releasing sleeve and a retaining member. The anti-releasing sleeve is sleeved on an end portion of the one of the lower support rod and the upper support rod located at inner side. The retaining member is disposed on an end portion of the other one of the lower support rod and the upper support rod located at outer side for the anti-releasing sleeve to abut against, so as to prevent the lower support rod and the upper support rod from being separated from each other.

The foregoing are only preferred embodiments of the present disclosure while the protection scope thereof is not limited to the above description. Any change or substitution within the technical scope disclosed by the present disclosure should be covered by the protection scope of the present disclosure.

The invention claimed is:

1. A crib comprising a body and a support frame supporting the body, the support frame comprising:

a lower frame configured to stand on a plane and having a lower support rod comprising a first lower rod and a second lower rod;

an upper frame connected to the body and having an upper support rod comprising a first upper rod and second upper rod, the first upper rod and the first lower rod being sleeved with each other and the second upper rod and the second lower rod being sleeved with each other, the upper support rod being capable of moving upward and downward with respect to the lower support rod; and an operating module connected to the first and second lower rods and the first and second upper rods and configured to lock and unlock movement between the upper support rod and the lower support rod.

2. The crib of claim 1, wherein one of the lower support rod and the upper support rod is sleeved within an inner side of the other one of the lower support rod and the upper support rod and has a plurality of lock portions arranged in an up-down direction, the operating module comprises a fixing base, a lock member, a returning member and an unlock member, the fixing base is disposed on the other one of the lower support rod and the upper support rod and forms a space for accommodating the lock member, the returning member and the unlock member, the lock member is disposed in the fixing base and capable of moving between a lock position and an unlock position, the lock member is fixed with one of the lock portions at the lock position, the returning member provides an elastic force for returning the lock member to the lock position, and the unlock member is disposed on the fixing base, and the unlock member drives the lock member to move from the lock position to the unlock position while being pressed.

3. The crib of claim 2, wherein the other one of the lower support rod and the upper support rod has an opening portion, the fixing base has a sleeve portion disposed on the other one of the lower support rod and the upper support rod and a mounting portion connected to the sleeve portion, the mounting portion has a transverse accommodating groove extending in a left-right direction and communicating with the opening portion and a longitudinal accommodating groove extending in the up-down direction and communicating with the transverse accommodating groove, the lock member and the returning member are accommodated in the transverse accommodating groove, and the unlock member is accommodated in the longitudinal accommodating groove and partially extends out of the mounting portion for pressing.

4. The crib of claim 3, wherein the lock member has a driving portion for the unlock member to drive, the driving portion has an inclined slot, the unlock member has a pin component sliding along the inclined slot, the unlock member is pressed to move in the up-down direction and slides along the inclined slot through the pin component, so as to drive the lock member to move from the lock position to the unlock position in the left-right direction.

5. The crib of claim 4, wherein the lock member further has an interfering portion engaging with one of the lock portions at the lock position.

6. The crib of claim 5, wherein the interfering portion has an inclined surface relative to the lock portion; when the upper frame is forced to move upward, the lock portion moves with respect to the inclined surface and pushes the inclined surface to drive the lock member to move toward the unlock position, so as to disengage the lock portion from the interfering portion.

7. The crib of claim 2, wherein the fixing base has a casing forming an accommodating space and a pivot located in the casing, the lock member is disposed on the pivot and capable of rotating with respect to the pivot, the lock member has an interfering portion, the interfering portion abuts against an end surface of the other one of the lower support rod and the upper support rod while being located at the lock position, the unlock member has a restraining hole for the interfering portion to pass through; and when the unlock member is pressed, the unlock member moves in the up-down direction and drives the interfering portion to move along the restraining hole.

8. The crib of claim 7, wherein the lock member further has a pivot portion sleeved on the pivot, and the interfering portion extends from the pivot portion.

9. The crib of claim 7, wherein the unlock member further has an avoidance groove for the pivot to pass through.

10. The crib of claim 7, wherein the unlock member further has a restraining groove extending in the up-down direction and configured to accommodate the returning member, the returning member is a compression spring, and opposite ends of the returning member respectively abut against the casing and the unlock member.

11. The crib of claim 7, wherein the fixing base further has a positioning plate extending from the casing and abutting against the end surface of the other one of the lower support rod and the upper support rod.

12. The crib of claim 1, wherein the support frame further comprises an anti-releasing sleeve and a retaining member, the anti-releasing sleeve is sleeved on an end portion of the one of the lower support rod and the upper support rod sleeved within an inner side of the other one of the lower support rod and the upper support rod, the retaining member is disposed on an end portion of the other one of the lower support rod and the upper support rod for the anti-releasing sleeve to abut against, so as to prevent the lower support rod and the upper support rod from being separated from each other.

* * * * *